US006903314B2

(12) United States Patent
Korfer et al.

(10) Patent No.: US 6,903,314 B2
(45) Date of Patent: Jun. 7, 2005

(54) WORK SURFACE ARRANGEMENT WITH A COOKING CELL

(75) Inventors: Hans-Peter Korfer, Haiger (DE); Martin Taplan, Rheinboellen (DE); Helga Gotz, Heidesheim (DE)

(73) Assignees: Teka Küchentechnik GmbH, Haiger (DE); Schott Glas, Main (DE)

( * ) Notice: Subject to any disclaimer, the term of this patent is extended or adjusted under 35 U.S.C. 154(b) by 0 days.

(21) Appl. No.: 10/471,092

(22) PCT Filed: Mar. 5, 2002

(86) PCT No.: PCT/EP02/02387

§ 371 (c)(1),
(2), (4) Date: Apr. 7, 2004

(87) PCT Pub. No.: WO02/071805

PCT Pub. Date: Sep. 12, 2002

(65) Prior Publication Data

US 2004/0155032 A1 Aug. 12, 2004

(30) Foreign Application Priority Data

Mar. 6, 2001 (DE) ..... 101 10 781
Mar. 6, 2001 (DE) ..... 101 10 784

(51) Int. Cl.[7] ..... H05B 6/12

(52) U.S. Cl. ..... 219/622; 219/624; 219/432; 219/649; 99/DIG. 14

(58) Field of Search ..... 219/620–627, 219/647, 649, 661, 429, 432–436; 99/DIG. 14

(56) References Cited

U.S. PATENT DOCUMENTS 5,687,642 A * 11/1997 Chao ..... 99/451
6,429,408 B2 * 8/2002 Muskalla et al. ..... 219/429

FOREIGN PATENT DOCUMENTS

DE 299 05 024 U1 7/1999
EP 0 629 820 A2 12/1994
JP 06302376 A * 10/1994 ..... H05B/6/12
JP 07201463 A * 8/1995 ..... H05B/6/12

* cited by examiner

*Primary Examiner*—Philip H. Leung
(74) *Attorney, Agent, or Firm*—Nixon Peabody LLP; David S. Safran

(57) ABSTRACT

A work plate arrangement (1) including a work plate (2) and a hot plate (3), the hot plate (3) being inserted in a recess (4) of the work plate (2). In order to provide a work plate arrangement (1) which also enables a wok to be used for cooking purposes in a simple manner, the hot plate (3) is provided with a shell (5) which is made of a glass ceramic material and which protrudes into the recess (4) of the work plate (2), the shell being used to receive a wok and having a heating device arranged thereunder (5).

25 Claims, 5 Drawing Sheets

WORK SURFACE ARRANGEMENT WITH A COOKING CELL

BACKGROUND OF THE INVENTION

1. Field of the Invention

The invention relates to a work surface arrangement with a work surface and with a cooking cell, the cooking cell being inserted in a recess of the work surface.

2. Description of Related Art

Work surface arrangements of the initially mentioned type have been known from practice for a long time. The cooking cell usually consists of a flat glass ceramic plate. Cooking with a wok on a flat ceramic plate is comparatively difficult and requires special aids. A wok is a cooking vessel with a round or hemispherical bottom. DE-U-299 05 024 already discloses using an induction heating means which is located under the cooktop to enable cooking with a wok. Above the cooktop there is a projecting holding means for holding the wok. The holding means is a type of ring for seating the wok.

The disadvantage is that heat transfer from the induction heating means to the wok is relatively poor. Moreover when using a holding ring there is the danger that the wok will overturn while cooking.

SUMMARY OF THE INVENTION

To achieve this object, a work surface arrangement is provided with a cooking cell that has a shell of glass ceramic which projects into the recess of the work surface for holding the wok. Underneath the shell, there is a heating means. In the embodiment of the present invention, the shell is integrated into the work surface as a wok holder. This is not only optically extremely pleasing, but there is no longer the danger of overturning of the wok. Moreover, good heat transfer takes place from the heating means through the glass ceramic shell to the wok since a separate component like the aforementioned holding ring is no longer necessary.

The heating means is made preferably as an induction heating means with at least one induction coil. The induction coil can spherically adjoin the spherical arch of the shell accordingly.

But there can also be only one or there can be several flat or plane induction coils which are located on the outside in the area of the shell. Moreover the heating need not necessarily take place by an induction heating means with at least one induction coil. This can also be undertaken by means of a conventional so-called Hilight heating body. In doing so for example there would also be the possibility of direct cooking on the glass ceramic, therefore without using a wok pan.

To enable the shell to be held in the recess a holding frame for the shell is attached to the work surface and in it the shell is inserted and held thereon. The holding frame itself has an optionally peripheral frame leg which is preferably attached to the end face of the recess of the work surface.

The holding frame however can also be designed not only for the placement of the shell for the wok, but can also be used for the placement of the induction heating means. In this connection the holding frame has a holding device for the induction heating means. Furthermore it is provided as claimed in the invention that the shell is supported on the induction heating means; this greatly facilitates mounting and installation.

In one especially preferred embodiment of this invention the transition of the shell to the work surface is frameless on the top. Such a configuration is most pleasing in designer terms and is also advantageous for cleaning. In this connection it is a good idea for there to be a joint with a small width on the transition of the shell to the work surface. But the joint should be kept as small as possible and should be only a few millimeters (1 to 3 mm). The joint should otherwise be sealed with a sealing or joint material. Furthermore in this connection it is a good idea for the top front edge of the shell to run horizontally and to be aligned with the top of the work surface. Here it goes without saying that the top front edge of the shell should be ground and polished accordingly.

But of course it is also possible to provide a corresponding peripheral frame instead of a frameless execution with surface-flush installation of the shell into the work surface. In this case the shell with the frame is inserted from the top into the opening of the work surface. The frame then lies on the work surface on the edge of the opening. The unit can be attached in this case from underneath, for example using tension claws.

In the aforementioned surface-flush installation of the shell into the work surface exact arrangement and secure holding of the shell in the recess on the retaining frame are necessary. In this connection it is a good idea in particular for the holding frame to have at least one holding leg acting against the shell. The holding leg should have a contact area which rests directly or indirectly against the bottom of the shell, which runs roughly parallel to the adjacent area of the shell and which faces the shell for secure fixing of the shell in the installation position. It is also possible to make this leg elastic. Moreover the leg can also be cemented to the shell in order to achieve secure attachment of the shell.

To be able to be adequately supported, the free end of the holding leg should be angled in the direction to the end face of the recess and either abut the end face or have a short distance to the end face. This execution of the free end of the holding leg however has another function. In this way the joint space of the above described joint is limited so that the sealing material for sealing the joint does not run out of this space.

For sufficient attachment of the shell to the work surface there are different mounting angles which can be mounted on the work surface on the bottom or on the front in the area of the recess. Since the shell consists of glass ceramic, it is a good idea to cement the mounting angles to the shell.

In one alternative embodiment—in contrast to the above described frameless installation—the holding frame has a support leg for top support on the work surface. In this case the mounting of the shell is extremely simple since the holding frame is placed simply on the top on the work surface.

Furthermore it is a good idea for the holding frame to have a cover leg which extends over the top front edge of the shell. Special machining of the edge is not necessary due to the hidden arrangement of the edge of the shell. Moreover the edge is protected via the cover leg against impact. The cover leg can however be used not only to cover the front edge of the shell, but it is also used preferably to extend over the joint between the work surface and the shell.

A secure arrangement of the shell within the holding frame is further achieved preferably by there being a holding angle which is bent especially down on the frame leg. This holding angle can be made elastic and preferably, as has already been described above, has a contact area which runs roughly parallel to the adjacent area of the shell. This contact area can likewise be cemented to the shell.

Especially when using a peripheral frame which is visible from the outside are there other possibilities. In one advantageous embodiment of the invention the support leg has a step shape with a receiver countersunk in the recess. A cover of the material of the work surface or another material which then rests on the receiver can then be inserted into the recess. The support leg and the cover should be made such that the cover in the inserted state is at least essentially aligned with the work surface.

Since the arrangement of the shell especially in the above described frameless installation requires levelling it is moreover provided that the holding leg and/or holding device can be vertically adjusted. The height of the shell can be set via the holding leg while via the vertical adjustment of the holding device first the induction heating means, and if the shell is resting on it, also the height of the shell can be adjusted. Preferably the vertical adjustment takes place via setscrews.

In handling during cooking not inconsiderable forces are applied to the shell. Especially in conjunction with the frameless structure in which the holding frame does not rest on the work surface, but is simply mounted on it for example via screws, it is a good idea to provide a damping means, especially between the frame leg on the one hand and the holding leg and/or the holding device on the other. The damping means can have individual elastic elements via which then in any case part of the force applied to the shell can be accommodated.

To achieve the initially mentioned object, it is provided as claimed in the invention in one alternative embodiment that on the work surface there rests a glass ceramic or special steel cooking cell area which projects into the recess; that the cooking cell area has an opening for inserting a wok, that there is a shell of glass ceramic located underneath the opening to hold the wok and that underneath the shell there is a heating means. In this way the advantages are the same as mentioned initially.

Preferably here the heating means is made as an induction means with at least one induction coil. The aforementioned features and advantages also arise here as otherwise also in other features of this embodiment which will not be detailed again below.

It is especially advantageous that the shell adjoins the bottom of the cooking cell area. The shell in this case is made as a separate component. But basically it is also possible to form the glass ceramic so that the shell is made in one piece with the cooking cell. In any case it is however such that a frame is not necessary on the transition from the shell to the cooking cell area. Optically this area also acts in a quasi jointless manner. Otherwise in the two-part execution for reasons of sealing it is a good idea for the shell to be braced against the cooking cell area, therefore pressed from underneath against the cooking cell area.

It is moreover of further advantage that the edge of the cooking cell area is aligned with the bordering area of the shell so that—optically viewed—the cooking cell area passes directly into the shell. It goes without saying that in this connection it is a good idea to grind and polish the edge of the cooking cell area on the opening accordingly.

As a result of the frameless arrangement of the shell against the cooking cell area which projects into the recess exact placement and secure holding of the shell on the holding frame are necessary. In this connection it is especially a good idea for the holding frame to have at least one holding leg which acts against the shell. The holding leg can be made fundamentally as a leg which is separate from the frame leg. But it is preferable for the holding leg to be made in one piece with the frame leg. This execution of the frame leg with the holding leg can be easily produced by bevelling and is economical.

For reliable fixing of the shell in the installation position the holding leg has a contact area which runs roughly parallel to the adjacent area and which faces the shell. It is also possible to make the holding leg or the contact area elastic. Moreover the contact area can also be cemented to the shell in order to achieve secure attachment of the shell.

For adequate attachment of the shell to the work surface, in addition to the above described means for attachment alternatively or also in combination with this on the bottom there can be mounting angles which can be mounted on the work surface on the bottom or front in the area of the recess. Since the shell consists of glass ceramic, it is a good idea to cement the mounting angles to the shell.

Since the arrangement of the shell underneath the cooking cell area and the advantageously provided bracing of the shell against the bottom of the cooking cell area require a corresponding adjustment, it is otherwise provided that the holding leg and/or the holding device are vertically adjustable. With respect to the vertical adjustment of the holding leg it is of course a prerequisite that there is a separate holding leg. If there is not, the vertical adjustment can be undertaken via the holding device with the induction heating means. Vertical adjustment takes place via the corresponding setscrews for the sake of simplicity.

In handling during cooking not inconsiderable forces are applied to the shell. It is therefore a good idea to provide a damping means, especially between the frame leg on the one hand and the holding device for the induction heating means on the other. The damping means can have individual elastic elements via which then in any case part of the force applied to the shell can be accommodated.

If the shell does not pass into the work surface with a very narrow cooking cell area, it is possible to assign a control unit with contact switches to the cooking cell. This is so-called "Touch-Control". When using a cooking cell area of glass ceramic the control unit is located preferably underneath the cooking cell area. If the cooking cell area consists of special steel, there must be a corresponding recess to enable actuation.

If the cooking cell area consists of glass ceramic, the control unit can be made as a separately operable unit which is located if necessary underneath the cooking cell area. But it is also possible to place the control unit with the contact switches elsewhere on the work surface or within the kitchen. Finally the control unit is a module which can be provided as an alternative.

Otherwise it is favorable for the cooking cell area to rest on a step of the work surface or to be made as a top layer of the work surface.

This yields a surface-flush arrangement. This arrangement can be easily cleaned and due to the absence of edges there is no danger of injury.

Only for the sake of good form is it pointed out that it is easily possible for the cooking cell area to extend over a larger area of the work surface and to lie not only on it, but thus also to be securely joined, especially cemented, to it.

Below the invention is described using embodiments.

DETAILED DESCRIPTION OF THE INVENTION

Figure 1:
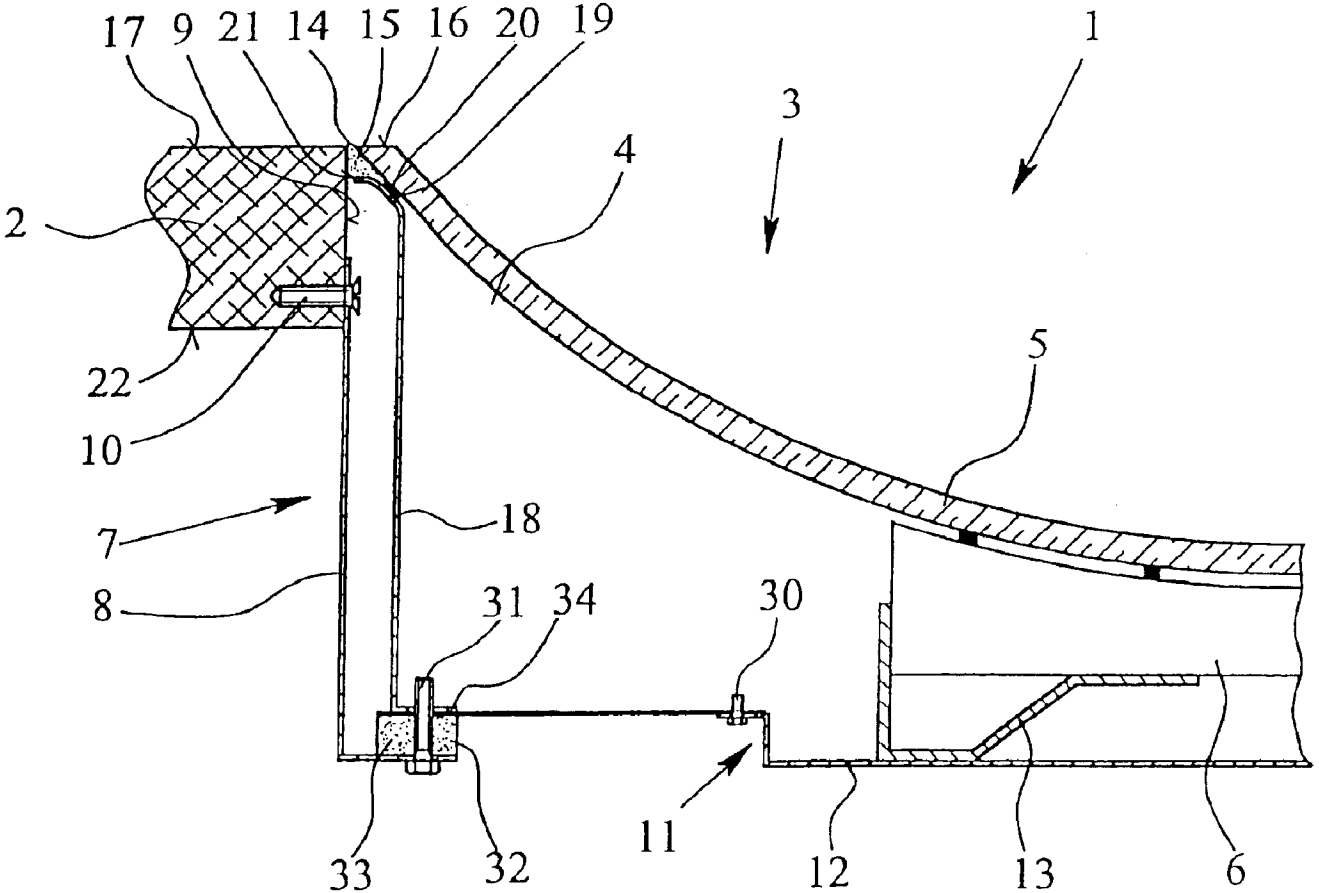
FIG. 1 shows a partial cross sectional view of a first embodiment of a work surface arrangement as claimed in the invention.

FIGS. 1 to 4 each show a work surface arrangement 1 which has a work surface 2 and a cooking cell 3. The work surface 2 can consist of any material, for example granite, plastic, wood or a composite material, especially of the aforementioned materials. In the work surface 2 there is a recess 4 into which the cooking cell 3 is inserted.

It is now provided that the cooking cell 3 has a shell 5 of glass ceramic which projects into the recess 4 of the work surface 2 for holding the wok which is not shown. The shell 5 is made spherical. It is furthermore important that underneath the shell 5 there is a heating means which is made as an induction heating means 6. The induction heating means 6 has at least one induction coil. It can be matched to the shape of the shell 5, but this is not absolutely necessary. Moreover it goes without saying that heating need not necessarily take place by at least one induction coil, but can also take place via other heating means.

A holding frame 7 for the shell 5 is attached to the work surface 2. The holding frame 7 which can be made peripheral, but can also consist of several individual frame parts, has a frame leg 8 which is attached to the end face 9 of the recess 4 of the work surface. Here the frame leg 8 is screwed to the work surface 2 via the corresponding screws 10.

Furthermore, on the holding frame 7 there is a holding device 11 for the induction heating means 6. The induction heating means 6 therefore lies directly or indirectly on the holding means 11. In this case the holding means 11 has a bottom area 12 on which the corresponding spring means 13 are mounted, on which in turn the induction heating means 6 rests. The shell 5 is otherwise supported, as follows from the individual figures, on the induction heating means 6.

In the embodiment shown in FIG. 1, the transition of the shell 5 to the work surface 2 on the top is frameless. This means that from the outside the frame part of the holding frame 7 cannot be detected. On the transition of the shell 5 to the work surface 2 there is a joint 14. The joint 14 has a small joint width of roughly 2 mm here. The joint 14 itself is sealed with sealing material 15. As follows further from FIG. 1 the top front edge 16 of the shell 5 runs horizontally and is aligned with the top 17 of the work surface 2.

In addition to the frame leg 8, the holding frame 7 has at least one holding leg 18 which acts against the shell 5. The holding leg 18 can be made peripheral. But there can also be several individual holding legs. The holding leg 18 has a contact area 19 which runs roughly parallel to the adjacent area of the shell 5 and which faces the shell 5. The shell 5 adjoins the contact area 19 flat. In this embodiment the contact area 19 is cemented to the shell 5 at 20.

The free end 21 of the holding leg 18 is angled in the direction to the end face 9 of the recess 4. In this embodiment the free end 21 has a short distance of roughly 2 mm to the end face 9. In this way there is an essentially limited joint space in which the seal material 15 is held.

It is not shown that mounting angles can be cemented to the shell 5 on the bottom and are attached either to the bottom 22 of the work surface 2 and/or the end face 9.

Figure 3:
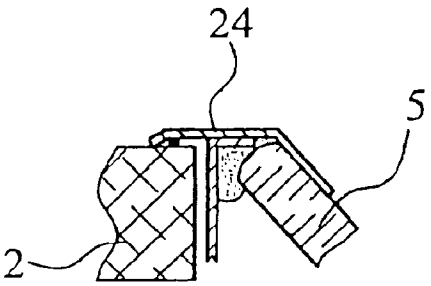
FIG. 3 shows a view of one alternative embodiment of the holding frame of the embodiment shown in FIG. 2.
Figure 2:
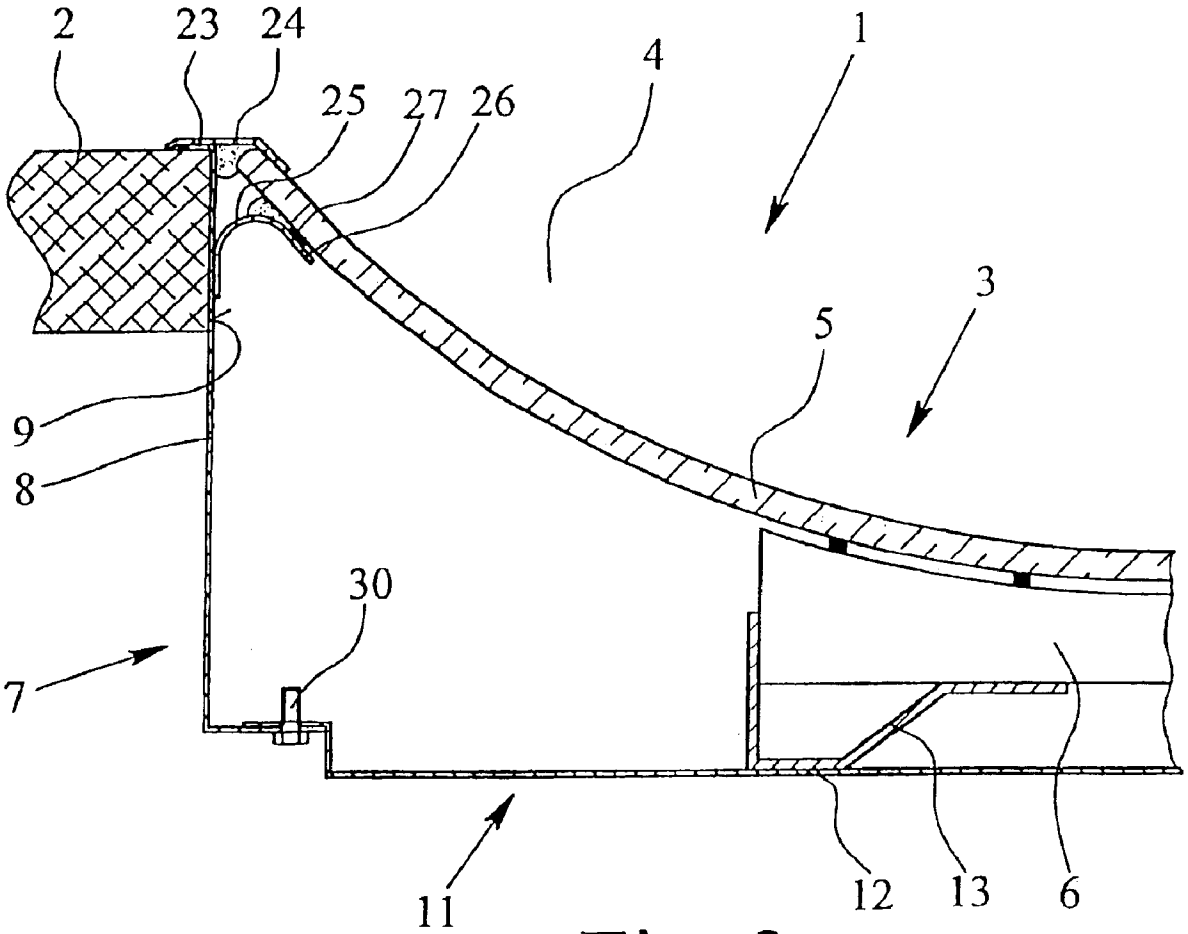
FIG. 2 shows a partial cross sectional view of another embodiment of a work surface arrangement as claimed in the invention.
Figure 4:
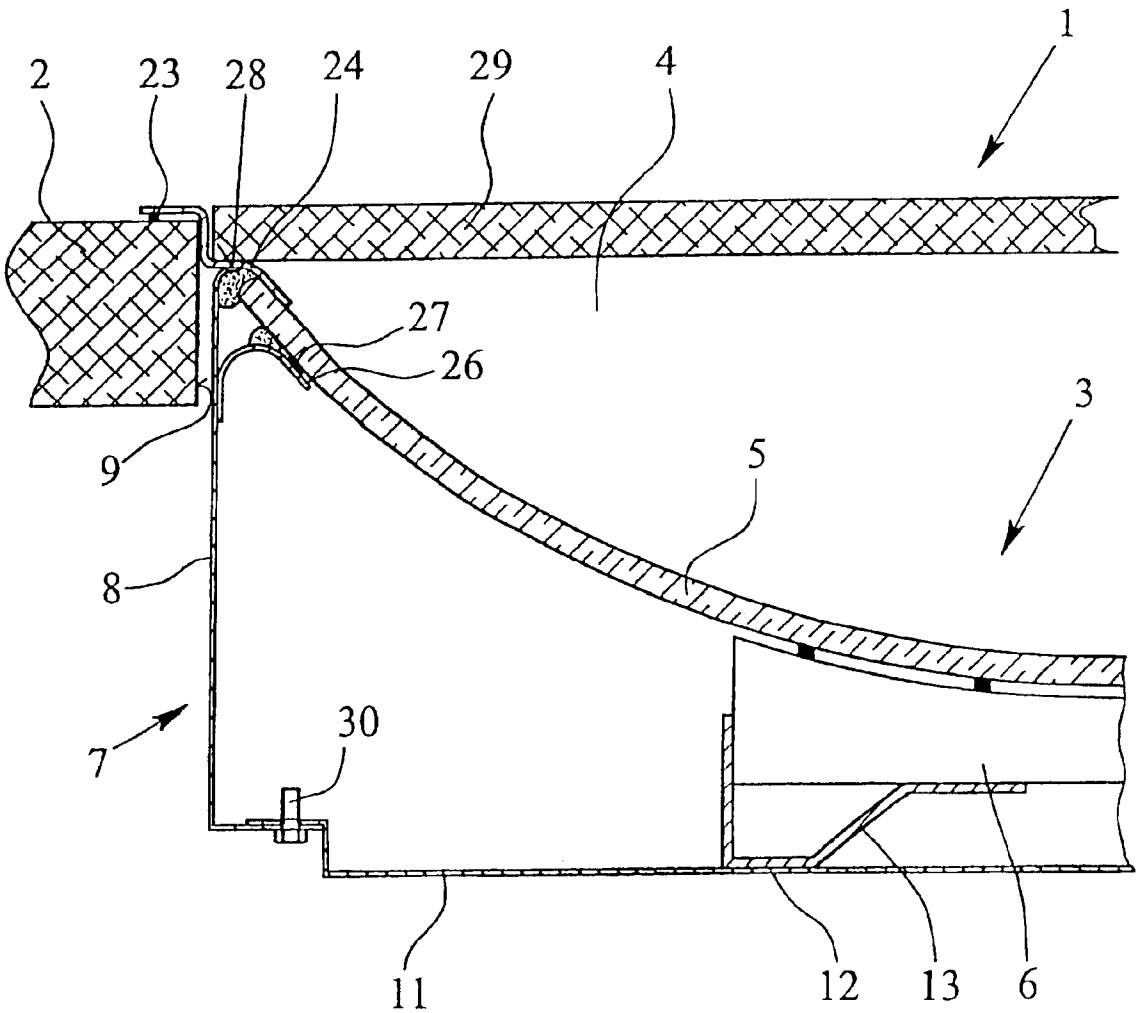
FIG. 4 shows a partial cross sectional view of a third embodiment of a work surface arrangement as claimed in the invention.

The embodiments of FIGS. 2 to 4 differ from the embodiment as shown in FIG. 1 in that on the outside a part of the holding frame 7 is apparent. The holding frame 7 has a support leg 23 for resting on top of the work surface 2 for support. Furthermore, the holding frame 7 has a cover leg 24 which extends over the top front edge 16 of the shell 5. The cover leg 24 otherwise covers the joint 14 between the work surface 2 and the shell 5. The cover leg 24 therefore extends around the entire recess 4. In the embodiment which is shown in FIG. 2 the support leg 23 is made integrally with the frame leg 8. The cover leg 24 is securely joined to the support leg 23. Also an integral execution by bending the cover leg 24 from the support leg 23 is possible. In the embodiment shown in FIG. 3 the cover leg 24 also rests on the work surface 2.

Otherwise it should be pointed out that it is not absolutely necessary for the frame leg 8 to be used for direct mounting on the work surface 2. It is also possible to provide other fasteners via which the holding frame 7 is attached or braced to the work surface 2.

For the two embodiments shown in FIGS. 2 and 4, on the frame leg 8 there is one holding angle 25 which is especially bent down. The holding angle 25, Like the above described holding angle 18, has a contact area 26 which runs roughly parallel to the adjacent area of the shell 5 and which faces the shell 5. The contact area 26 is cemented to the shell 5 at 27. But this is only one optional possibility.

Otherwise, as follows from FIGS. 2 to 4, the area between the front edge 16 of the shell 5 and the cover leg 24 has a corresponding sealing means. The same applies to the area between the holding angle 25 and the shell 5.

The embodiment as shown in FIG. 4 corresponds essentially to that as shown in FIG. 3. But here it is such that the support leg 23 has a step shape and thus forms a receiver 28 which is countersunk in the recess 4. The receiver 28 is preferably peripheral here. Furthermore there is a cover 29 for insertion into the recess 4 and for resting on the receiver 28. In this embodiment the support leg 23 and the cover leg 24 are made in one piece. Otherwise it is such that the support leg 23 and the cover 29 are made such that the cover 29 in the inserted state is aligned on the top with the work surface 2 or the support leg 23 or the cover leg 24. In this way the space occupied by the shell 5 can be used in the covered state for a rest.

In all embodiments it is such that the holding means 11 is vertically adjustable. In the embodiment shown in FIG. 1 the holding leg 18 is also vertically adjustable. Here setscrews 30, 31 are used for vertical adjustment. Otherwise in the embodiment shown in FIG. 1 it is such that between the frame leg 8 on the one hand and the holding leg 18 and the holding device 11 on the other there is a damping means 32. In particular, the frame leg 8 has a lower angle 33 on which the elastic element of the damping means rests 32 rests. On the elastic element of the damping means 32 there lie on the one hand the holding means 11 and on the other the bent leg 34 of the holding leg 18. The setscrew 31 is routed through the damping means 32 to fix the latter.

In an embodiment which is not shown, on the top end of the shell 5, therefore in the area of the top front edge 16 there is a holding frame which rests on the top 17 of the work surface 2 in the installed state. The holding frame can be attached to the work surface 2 via various fasteners, for example via tension claws which engage the bottom 22 of the work surface 2.

Figure 5:
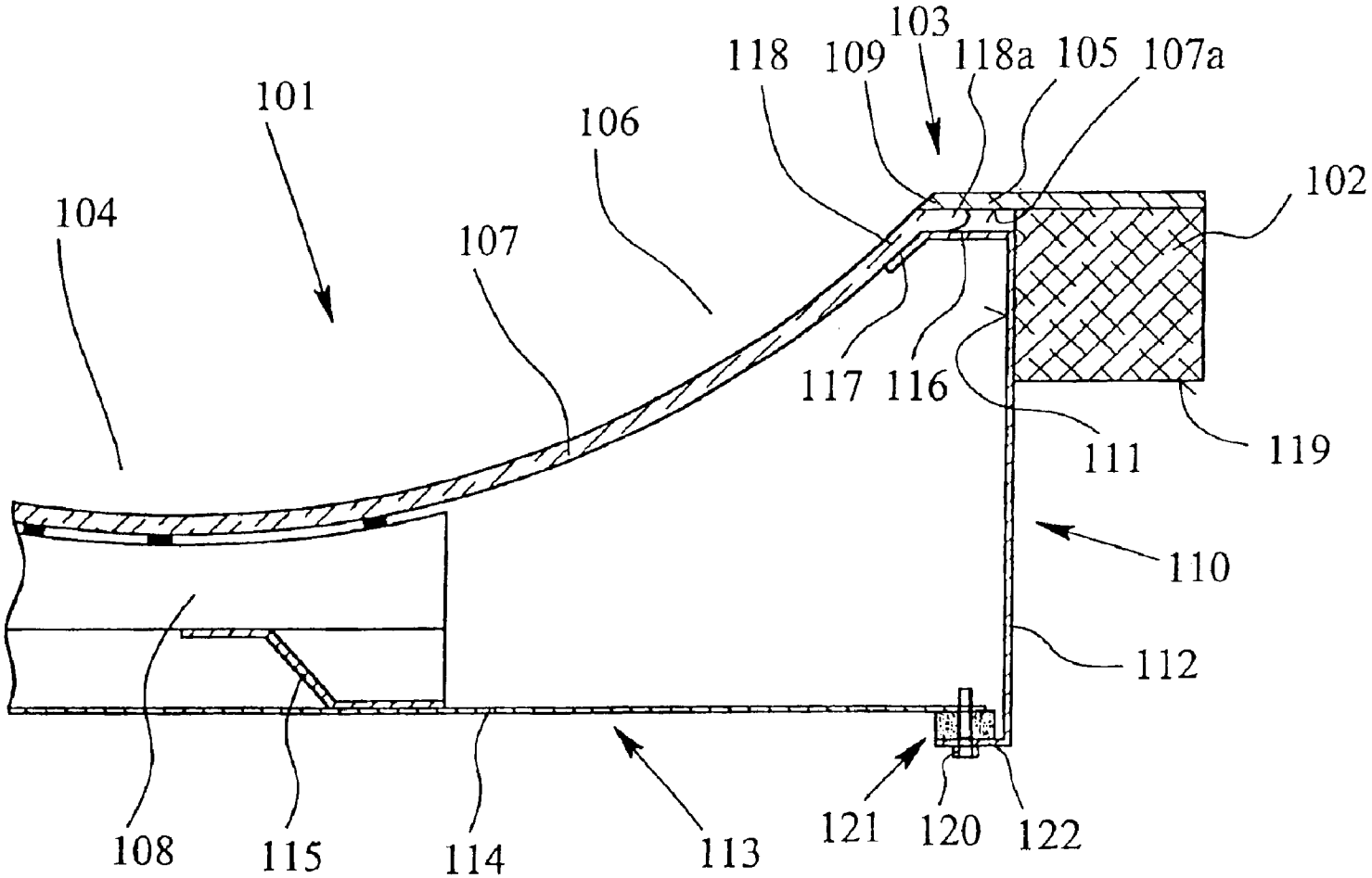
FIG. 5 shows a partial cross sectional view of a first embodiment of a work surface arrangement as claimed in the invention.
Figure 6:
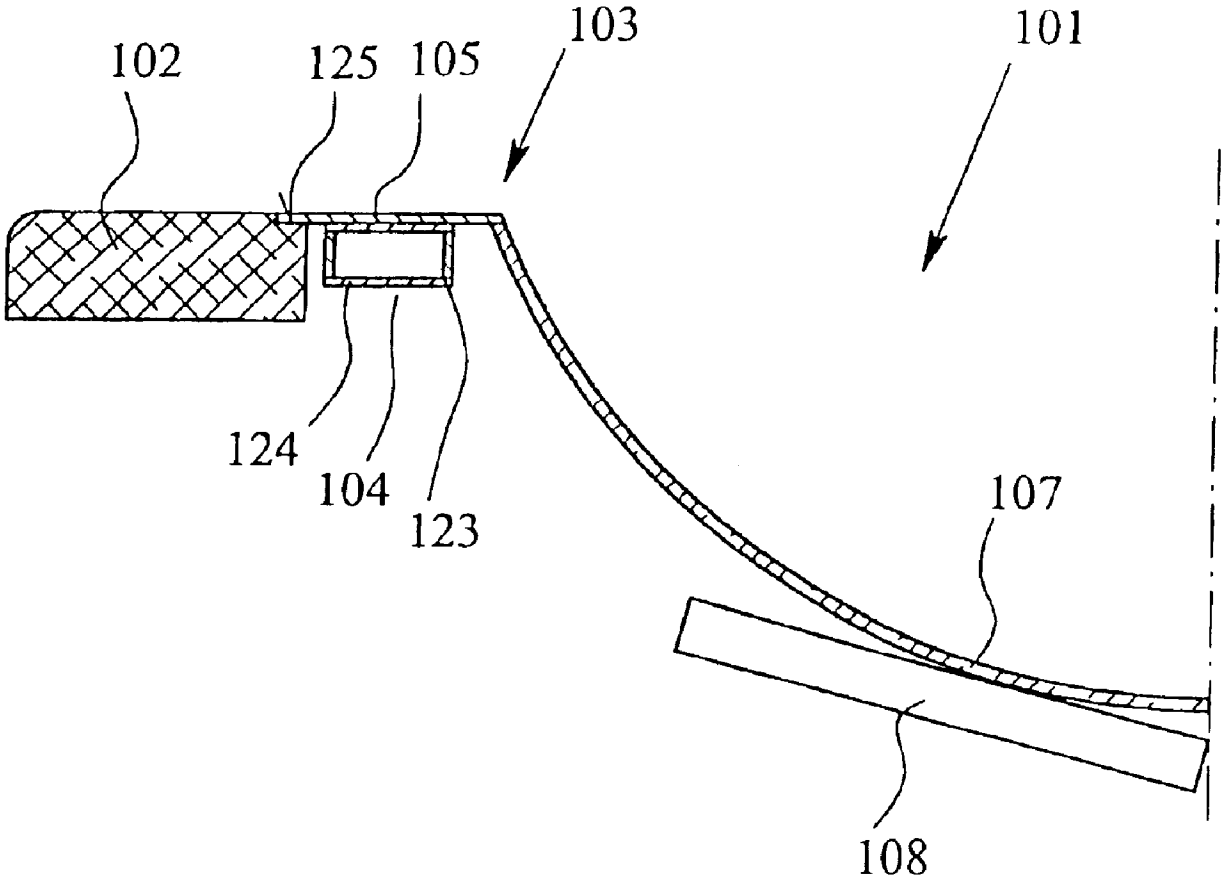
FIG. 6 shows a schematic in a partial cross sectional view of another embodiment of a work surface arrangement as claimed in the invention.

FIGS. 5 and 6 each show one work surface arrangement 101 which has a work surface 102 and a cooking cell 103. The work surface 102 can consist of any material, for example granite, plastic, wood or a composite material, especially of the aforementioned materials. In the work surface 102 there is a recess 104 into which the cooking cell 103 is inserted.

It is provided here that a glass ceramic or special steel cooking cell area 105 which projects into the recess 104 rests on the work surface 102. A glass ceramic cooking cell area 105 conventionally has a thickness from 4 to 6 mm, but also other thicknesses being possible. The cooking cell area 105 can be a separate component or part of the work surface 102. It is furthermore provided that the cooking cell area 105 has an opening 106 for insertion of a wok which is not shown, that there is a shell 107 of glass ceramic located underneath the opening 106 to hold the wok and that underneath the shell 107 there is a heating means which is made as an induction heating means 108. The induction heating means 108 has at least one induction coil. It can be matched to the shape of the shell 107, but this is not absolutely necessary. Otherwise the heating need not necessarily take place by an induction heating means with at least one induction coil. Use of other heating bodies is also possible.

As follows from FIG. 5, the shell 107 adjoins the bottom 107*a* of the cooking cell area 105. The shell 107 is braced here against the cooking cell area 105. The details are discussed below. The edge 109 of the cooking cell area 105 which borders the opening is aligned with the bordering area of the shell 107. The edge 109 is therefore bevelled accordingly, i.e. is ground and polished accordingly.

A holding frame 110 for the shell 107 is attached here to the work surface 102. The holding frame 110 which can be made peripheral, but can also consist of several individual frame parts, has a frame leg 112 which is to be attached to the end face 111 of the recess 104 of the work surface 102. The frame leg 112 could be attached, which is not shown, to the work surface via the corresponding screws which are screwed into the end face 111.

Furthermore, on the holding frame 110 there is a holding device 113 for the induction heating means 108. The induction heating means 108 therefore lies directly or indirectly on the holding device 113. In this case the holding device 113 has a bottom area 114 on which the corresponding spring means 115 are mounted, on which in turn the induction heating means 108 rests. The shell 107 is otherwise supported on the induction heating means 108.

The holding frame 110 here has at least one holding leg 116 which acts against the shell 107. The holding frame 116 can be made peripheral. But there can also be several individual holding legs. The holding leg 116 is made here integrally with the frame leg 112, this however need not necessarily be the case. As a result of the integral execution, the holding leg 116 is beveled from the frame leg 112 and otherwise has contact area 117 which runs roughly parallel to the adjacent area of the shell 107 and which faces the shell 107. The shell 107 adjoins the contact area 117 flat. In this embodiment the contact area 117 is cemented to the shell 107 at 118. Otherwise the shell 107 has a horizontal support edge 118*a* which rests on the holding leg 116.

It is not shown that mounting angles can be cemented to the shell 107 on the bottom and are attached either to the bottom 119 of the work surface 102 and/or the end face 111.

Otherwise, in the embodiment shown in FIG. 5 it is such that the holding device 113 is vertically adjustable. There are setscrews 120 for this purpose. But not only can the correct arrangement of the induction heating means 108 be set via the setscrews 120, but the shell 107 can also be braced against the bottom 107*a* of the cooking cell area 105.

Otherwise in the embodiment shown in FIGS. 5 and 6 it is such that between the frame leg 112 on the one hand and the holding device 113 on the other there is a damping means 121. In particular the frame leg 112 has a lower angle 122 on which at least one elastic element of the damping means 121 rests. The holding device 113 with the bottom area 114 rests on the elastic element of the damping means 121. To fix the damping means 121 a setscrew 120 is routed through the damping means 121.

FIG. 6 shows one embodiment of a work surface arrangement 101 in which the cooking cell area 105 likewise projects into the recess 104 of the work surface 102. The induction heating means 108 is located underneath the shell 107. A description of the type of attachment of the induction heating means 108 has been omitted. It is important in this connection simply that the induction heating means 108 is located underneath the shell 107.

In the embodiment shown in FIG. 6 it is now such that a control unit 123 with contact switches which are not shown for operation of the cooking cell 103 is assigned to the cooking cell 103.

The control unit 123 is located underneath the cooking cell area 105 here. The control unit 123 is a separately operable unit which is located in the housing 124 and could easily also be placed elsewhere.

It goes without saying that the control unit shown in the embodiment in FIG. 6 can likewise be provided in the embodiment as shown in FIG. 5.

Otherwise, in the embodiment shown in FIG. 6 it is such that the cooking cell area 105 has only a comparatively narrow width and rests with its edge on a step 125 of the work surface 102. On the top the cooking cell area 105 is aligned with the work surface 102. In the embodiment shown in FIG. 5 in which the cooking cell area 105 extends over a larger area of the work surface 102, there can be the configuration as in FIG. 6.

Instead of the above described embodiment with the shell 107 which adjoins the bottom 107*a* of the cooking cell area 105, it is fundamentally also possible to make the cooking cell area 105 and the shell 107 in one piece or to arrange the shell 107 by the corresponding vertical adjustment such that the upper edge of the shell 107 is aligned at the top with the cooking cell area 105. In this case, between the cooking cell area 105 and the shell 107 there is a joint which can be sealed and if necessary covered via cover means.

What is claimed is:

1. Work surface arrangement (1) with a work surface (2) and a cooking cell (3), the cooking cell (3) being inserted into a recess (4) of the work surface (2), characterized in that the cooking cell (3) has a shell (5) of glass ceramic which projects into the recess (4) of the work surface (2) for holding a wok, and that underneath the shell (5), there is a heating means for heating the wok, the work surface arrangement further including a holding frame (7) for the shell (5), the holding frame (7) having a substantially vertical frame leg (8) attached to the work surface (2), and having at least one holding leg (18) which acts against the shell (5).

2. Work surface arrangement as claimed in claim 1, wherein the heating means is made as an induction heating means (6) with at least one induction coil.

3. Work surface arrangement as claimed in claim 1, wherein the holding frame (7) has a frame leg (8) attachable to the end face (9) of the recess (4) of the work surface, wherein the holding frame (7) has a holding device (11) for the induction heating means (6) and the shell (5) is supported on the induction heating means (6).

4. Work surface arrangement as claimed in claim 3, wherein the holding leg (18) has a contact area (19) which runs roughly parallel to the adjacent area of the shell (5) and which faces the shell (5), and wherein the contact area (19) is cemented to the shell (5).

5. Work surface arrangement as claimed in claim 4, wherein the free end (2) of the holding leg (18) is angled in the direction to the end face (9) of the recess (4) and either abuts the end face (9) or has a short distance to the end face (9).

6. Work surface arrangement as claimed in claim 3, wherein the holding frame (7) has a support leg (23) for top support on the work surface (2), wherein the holding frame (7) has a cover leg (24) which extends over the top front edge (16) of the shell (5), and wherein the cover leg (24) extends over the joint (14) between the work surface (2) and the shell (5).

7. Work surface arrangement as claimed in claim 6, wherein on the frame leg (8) there is one holding angle (25) which is bent down, wherein the holding angle (25) has a contact area (26) which runs roughly parallel to the adjacent area of the shell (5) and which faces the shell (5), and the contact area (26) is cemented to the shell (5).

8. Work surface arrangement as claimed in claim 6, wherein the support leg (23) bas a step shape with a receiver (28) countersunk in the recess (4), wherein there is a cover (29) for insertion into the recess (4) and for resting on the receiver (28), and wherein the support leg (23) and the cover (29) are made such that the cover (29) in the inserted state is at least essentially aligned with the work surface (2) or the cover leg (24) on the top.

9. Work surface arrangement as claimed in claim 6, wherein the holding leg (18) and or holding device (11) is vertically adjustable, and wherein vertical adjustment takes place via setscrews (31).

10. Work surface arrangement as claimed in claim 3, wherein there is a damping means (32) between the frame leg (8) on the one hand and the holding leg (18) and/or the holding device (11) on the other for providing a dampened connection.

11. Work surface arrangement as claimed in claim 1, wherein the transition of the shell (5) to the work surface (2) is frameless on the top, wherein on the transition of the shell (5) to the work surface (2) there is a joint (14) with a small width and wherein the joint (14) is filled with sealing material (15).

12. Work surface arrangement as claimed in claim 1, wherein the top front edge (16) of the shell (5) runs horizontally and is aligned with the top (17) of the work surface (2).

13. Work surface arrangement as claimed in claim 1, wherein on the bottom there are mounting angles on the shell (5) cemented thereto and the mounting angles are mounted on the work surface (2).

14. Work surface arrangement (101) with a work surface (102) and a cooking cell (103), the cooking cell (103) being inserted into a recess (104) of the work surface (102), wherein a glass ceramic or steel cooking cell area (105) which projects into the recess (104) rests on the work surface (102), wherein the cooking cell area (105) has an opening (106) for insertion of a wok, wherein there is a shell (107) of glass ceramic located in the area of the opening (106) to hold the wok, and wherein underneath the shell there is a heating means for heating the wok, the work surface arrangement further including a holding frame (110) for the shell (107), the holding frame (110) having a substantially vertical frame leg (112) attached to the work surface (102), and having at least one holding leg (116) which acts against the shell (107).

15. Work surface arrangement as claimed in claim 14, wherein the heating means is made as an induction heating means (108) which has at least one induction coil.

16. Work surface arrangement as claimed in claim 14, wherein the shell (107) is made as a separate component and adjoins the bottom (107*a*) of the cooking cell area (105), wherein the shell (107) is braced against the cooking cell area (105) and the edge (109) of the cooking cell area (105) is aligned with the bordering area of the shell (107).

17. Work surface arrangement as claimed in claim 14, wherein the shell (107) is made in one piece with the cooking cell area (103).

18. Work surface arrangement as claimed in claim 14, wherein the holding frame (110) has a frame leg (112) which is attachable to the end face (111) of the recess (104) of the work surface (102), wherein on the holding frame (113) there is a holding device (113) for the induction heating means (108) and the shell (107) is supported on the induction heating means (108).

19. Work surface arrangement as claimed in claim 18, wherein the holding leg (116) is made in one piece with the frame leg (112), wherein the holding leg (116) has a contact area (117) which runs roughly parallel to the adjacent area of the shell (107) and which faces the shell (107), and wherein the contact area (117) is cemented to the shell (107).

20. Work surface arrangement as claimed in claim 18, wherein the holding leg and/or holding device (113) is vertically adjustable and wherein vertical adjustment takes place via setscrews (120).

21. Work surface arrangement as claimed in claim 18, wherein there is a damping means (121) between the frame leg (112) on the one hand and the holding leg and/or the holding device (113) on the other for providing a dampened connection.

22. Work surface arrangement as claimed in claim 14, wherein on the bottom there are mounting angles on the shell (107), cemented thereto and wherein the mounting angles are mounted on the work surface (102).

23. Work surface arrangement as claimed in claim 14, wherein a control unit (123) with contact switches is assigned to the cooking cell (103), wherein the control unit (123) is located underneath the cooking cell area (105) or in the recess of the cooking cell area, and wherein the control unit (123) is made as a separately operable unit.

24. Work surface arrangement as claimed in claim 23, wherein the cooking cell area (105) rests on a step (125) of the work surface (102) and is aligned on the top with the work surface (102).

25. Work surface arrangement (1) with a work surface (2) and a cooking cell (3), the cooking cell (3) being inserted into a recess (4) of the work surface (2), characterized in that the cooking cell (3) has a shell (5) of glass ceramic which projects into the recess (4) of the work surface (2) for holding a wok, a heating means for heating the wok underneath the shell (5), the work surface arrangement further including a holding frame (7) for the shell (5), the holding frame (7) having a substantially vertical frame leg (8) attachable to the work surface, wherein the frame leg (8) has least one holding angle (25).

* * * * *